United States Patent [19]

Tanasawa et al.

[11] 4,292,947

[45] Oct. 6, 1981

[54] SPILL TYPE SWIRL INJECTOR

[75] Inventors: Yasusi Tanasawa, Nagoya; Norio Muto, Aichi; Akinori Saito; Kiyomi Kawamura, both of Nagoya, all of Japan

[73] Assignee: Kabushiki Kaisha Toyota Chuo Kenkyusho, Nagoya, Japan

[21] Appl. No.: 92,036

[22] Filed: Nov. 7, 1979

[30] Foreign Application Priority Data

Nov. 7, 1978 [JP] Japan ..... 53-137630

[51] Int. Cl.[3] ..... B05B 1/32; F02B 3/00; F02G 3/00

[52] U.S. Cl. ..... 123/445; 239/585; 239/124; 123/472

[58] Field of Search ..... 123/32 EA, 139 E, 32 AB, 123/32 AE; 239/585, 124

[56] References Cited

U.S. PATENT DOCUMENTS

| | | | |
|---|---|---|---|
| 3,241,768 | 3/1966 | Croft | 239/124 |
| 3,967,598 | 7/1976 | Rachel | 123/139 E |
| 4,179,069 | 12/1979 | Knapp et al. | 239/585 |
| 4,184,459 | 1/1980 | Ishii et al. | 123/139 E |
| 4,200,073 | 4/1980 | Stoltman | 123/139 E |

*Primary Examiner*—Charles J. Myhre
*Assistant Examiner*—R. A. Nelli
*Attorney, Agent, or Firm*—Oblon, Fisher, Spivak, McClelland & Maier

[57] ABSTRACT

A spill type swirl injector includes a nozzle body, an injection port, a pressurized fluid induction passage, a valve assembly, a swirl chamber, two tangential pressurized fluid supply passages and a spill assembly including two spill openings provided on an outer cylindrical wall of a movable member of the valve assembly and opened to inner side of the swirl chamber. An axial hole provided in the movable member of the valve assembly and in the nozzle body and discharge passage assembly is connected to a pressurized fluid supply source, thereby spilling a predetermined quantity of the pressurized fluid from the inner side of the swirl chamber through the spill opening, axial hole and spill passage assembly. The spill type swirl injector immediately injects the fluid in the form of a liquid film flow having a sufficiently high swirling velocity, after the valve is opened, so that the sprayed liquid droplets are remarkably fine and uniform and the atomizing characteristics and response of the atomization to the injection pressure are improved in comparison with prior spill type swirl injectors.

6 Claims, 12 Drawing Figures

SPILL TYPE SWIRL INJECTOR

BACKGROUND OF THE INVENTION

1. Field of the Invention

This invention relates to a spill type swirl injector,

2. Description of the Prior Art

In case the conventional swirl injector is applied to a reciprocating gasoline or diesel engine, the following practical problems arise in the swirl injector, in which the fuel is supplied at an inconstant flow rate while being timely varied or in the swirl injector intermittently injecting the fuel, which is equipped with such a valve device as has communication with a swirl chamber and continuously performs the opening and closing operations of the injector at an extremely high speed.

In this valve device, since the fuel is left, while the valve device is shut off, in the swirl chamber without the swirling energy and is swirled and injected when the valve device is opened, the swirling energy cannot be utilized effectively with a substantial delay in response so that a sufficiently stable liquid film is not established after the valve device is opened, thus allowing coarse droplets to be injected and supplied. Moreover, the valve device cannot be free from such problems in construction and with the precision needed in machining and assembling. And coupled with the technical limitation, both of the fuel atomization characteristics and the response of the fuel injection to the injection pressure cannot be sufficiently expected for the fuel injection under the inconstant flow condition or deteriorated in some cases, which invite various difficulties such as directional instability of the injected fuel and the like. As a result, the aforementioned injection device causes inconvenience in engine operations in its practical use, namely the coarse fuel droplets in the fuel supplied and the intake air cannot be sufficiently admixed to wet the inner wall of the intake pipe with the fuel to thereby fail to effect the desired stable and smooth fuel supply to the combustion chambers so that satisfactory completion of the combustion is so difficult as to invite misfire to thereby deteriorate the drivability of the engine and to invite generation of the noxious gases and poor fuel economy.

For the purpose of overcoming the above-mentioned drawbacks, a spill type swirl injection valve, which forms swirling flow in a swirl chamber at any time by spilling a part of fuel supplied into the swirl chamber, has already been proposed. Namely, a spill type swirl injection valve $A_o$ as shown in FIGS. 1 and 2 in the conventional one.

In the conventional injection valve $A_o$, a spill opening is arranged to be communicated with a swirl chamber 12 through a fuel spill passage 161. The fuel spill passage 161 is a longitudinal annular passage which is defined between the outer wall of a valve guide 81 for a needle valve 80 and the inner wall of a valve guide bore 5 for a nozzle member 4. The valve guide 81 is placed just above the swirl chamber 12. The spill opening 160 is opened into the needle valve 80 above the valve guide 81 provided with polygonal sides 84 at the outer periphery thereof. The fuel being swirled within the swirl chamber 12 is spilled into the spill opening 160 therefrom through the fuel spill passage 161.

This conventional spill type swirl injection valve $A_o$, however, has the following practical problems. Since a part of the fuel having a swirling flow is delivered from the swirl chamber 12 through the fuel spill passage 161 placed just above the swirl chamber 12, the fuel is spilled from the outer periphery of the swirl chamber where the swirling flow velocity becomes maximum and also the swirling energy of the fuel is decreased by the axial flow to the fuel spill passage 161. As a result, loss of the swirling energy is remarkable and it becomes impossible to establish intensive or strong swirling flow in the swirl chamber 12 essentially required for improvement of atomization of fuel.

In addition to the above-mentioned drawbacks, the following disadvantages in practical use also arise. Namely, resistance to the swirling flow within the swirl chamber 12 is afforded due to the polygonal sides 84 facing the fuel spill passage 161 so that the swirling energy within the swirl chamber 12 is suppressed by such resistance and, simultaneously, the fuel is required to be spilled from the outer periphery of the swirl chamber 12 where the pressure of the swirling flow becomes minimum. Therefore, it is impossible to satisfactorily spill the fuel.

Accordingly, the conventional spill type swirl injector cannot satisfactorily establish the swirling flow within the swirl chamber 12 so that at the initial time point of injection the injection valve produces dripping of the fuel, a nonuniform flow rate and instability in the injection angle of the fuel. Furthermore, such causes non-uniformity in practice diameters of sprayed fuel.

Thus, the conventional spill type swirl injection valve $A_o$ has many problems which must be solved for its practical use.

SUMMARY OF THE INVENTION

The present invention relates to an improved spill type swirl injector which is used as a liquid particle generator in various fuel injectors for a thermal prime mover.

One object of the present invention is to provide an improved and practically useful spill type swirl injector.

It is another object of the present invention to provide an improved spill type swirl injector which allows fuel to flow in a swirl chamber at all times to thereby establish a strong swirling flow therein without decreasing the swirling energy thereof.

It is still another object of the present invention to provide an improved spill type swirl injector which forms a sufficiently stable fuel film immediately after the valve is open due to establishment of a strong swirling flow.

It is a further object of the present invention to provide an improved spill type swirl injector which has remarkably satisfactory liquid atomization characteristics and high response to the injection pressure without defects and drawbacks of the prior art.

It is a still further object of the present invention to provide an improved spill type swirl injector in which the control of injection quantity can be accomplished remarkably accurately and feasibly by suitably predetermining the effective area of a throttle provided in the injector to thereby establish stable atomization with excellent response to the opening of the needle valve with a smaller spilling quantity than the injection quantity.

It is a still further object of the present invention to provide an improved spill type swirl injector which can control the quantity of injection by adjusting the effective area of a variable throttle provided in the injector in response to the running condition of the engine, such as negative pressure in an intake manifold, the number of revolutions, engine load and the like and by varying the quantity to be spilled, to thereby establish a swirling flow having constantly stable atomization characteristics in any running condition of the engine.

It is a still further object of the present invention to provide an improved spill type swirl injector having an improved and simplified construction to allow facilitated manufacturing, machining and assembling suitable for mass-production.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
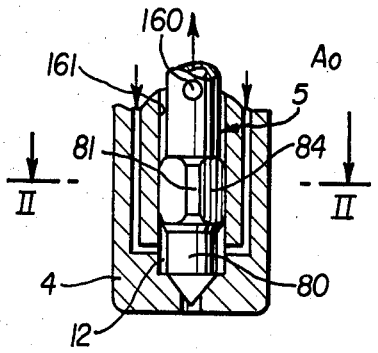
FIG. 1 PRIOR ART
FIGS. 1 and 2 are, respectively, a partially enlarged longitudinal sectional view and a transverse sectional view showing a conventional spill type swirl injection valve.
Figure 2:
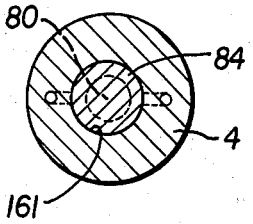
FIG. 2 PRIOR ART

An improved spill type swirl injector according to the present invention is constructed so as to swirl the pressure fluid within a swirl chamber with high efficiency and to spill the pressure fluid from the central portion of the swirl chamber.

The spill type swirl injector according to the present invention includes a nozzle body; an injection port opening at an end of the nozzle body for injecting pressurized fluid; a pressurized fluid induction passage provided within the nozzle body, the pressurized fluid induction passage being connected to a pressurized fluid supply source through a pressurized fluid supply passage assembly; a valve assembly having a movable member interposed into the injection port for controlling the fluid injection by on-off controlling the fuel supply to the injection port; a swirl chamber including an annular chamber formed between an inner cylindrical wall of the end of the nozzle body and an outer cylindrical wall of the movable member of the valve assembly, at a position adjacent to the injection port within the nozzle body, the swirl chamber being connected to said injection port; at least one tangential pressurized fluid supply passage formed within the nozzle body in communication with the pressurized fluid induction passage and opening into an outer side wall of the swirl chamber in the tangential direction thereof, in order to form a swirling flow of the pressurized fluid within the swirl chamber; and spill means comprising at least one spill opening provided on the outer cylindrical wall of the movable member of the valve assembly and opened into inner side of the swirl chamber, an axial hole provided in the movable member and connected to the spill opening, and a spill passage assembly connected to the axial hole and the pressurized fluid supply source, thereby spilling a predetermined quantity of the pressurized fluid from the inner side of the swirl chamber through the spill opening, axial hole and spill passage assembly whereby fluid is injected in the form of a liquid film flow having a sufficiently high swirling velocity immediately after the valve is opened so that the sprayed liquid droplets are remarkably fine and uniform and the atomizing characteristics and response of atomization of the injection pressure are improved.

Due to such construction, it is possible to satisfactorily spill the pressure fluid along the direction of the swirling flow in the swirl chamber without reducing the swirling energy thereof. Further, since the pressure fluid is spilled from the central portion (inner portion) of the swirl chamber where the swirling flow velocity of the pressure fluid is low, loss of the swirling energy of the pressure fluid is remarkably reduced to thereby satisfactorily establish intensive or strong swirling flow within the swirl chamber. Furthermore, it is possible to surely obtain desired quantity of the pressure fluid to be spilled, because the pressure fluid is spilled from the central (inner) portion of the swirl chamber where the pressure of the swirling flow is high.

In the improved spill type swirl injector according to the present invention, the pressure fluid is constantly swirled within the swirl chamber with intensive or strong flow so that the pressure fluid can be injected and supplied in a satisfactory flow rate and injection angle from the injection port to the outside, immediately after the valve is opened at a predetermined timing. As a result, the fuel can be injected, immediately after the valve is opened, in the form of a liquid film flow having a sufficiently high swirling velocity so that the liquid droplets sprayed from the injection port can be remarkably fine and uniform to thereby remarkably improve the atomizing characteristics in comparison with the prior art.

Further, an improved spill type swirl injector according to the present invention is also provided with a throttle assembly having a predetermined throttle provided on the spill passage assembly so that the spilling quantity of the pressurized fluid flowing through the spill passage assembly is maintained constant and the injection quantity of the pressurized fluid injected from the injection port is also stably maintained.

Furthermore, an improved spill type swirl injector according to the present invention is also provided with variable throttle means having a variable throttle provided on the spill passage means, thereby controlling the spilling quantity of the pressurized fluid flowing through the spill passage assembly and controlling the injection quantity of the pressurized fluid injected from the injection port. Thus, the variable throttle assembly is so constructed that the effective area of the variable throttle can be adjusted in accordance with running conditions of the engine, such as engine load, negative pressure in an intake manifold, manifold temperature and temperature of engine cooling water. Thus, by adjusting the effective area of the variable throttle in response to changes of the running condition of an engine, the injection quantity of fuel can be increased or decreased without changing the pressure and flow rate in the fuel pump and injection pulse width of the valve device. According to the improved spill type swirl injector provided the variable throttle therein, the fuel can be satisfactorily injected and supplied with high accuracy and ease even at the starting of the internal combustion engine and upon acceleration of the engine.

Still further, an improved spill type swirl injector according to the present invention is also provided with both a throttle assembly having a predetermined throttle provided on the spill passage assembly and a variable throttle assembly having a variable throttle provided on the spill passage assembly, thereby controlling the spilling quantity of pressurized fluid flowing through the spill passage assembly and controlling the injection quantity of the pressurized fluid injected from the injection port.

Figure 3:
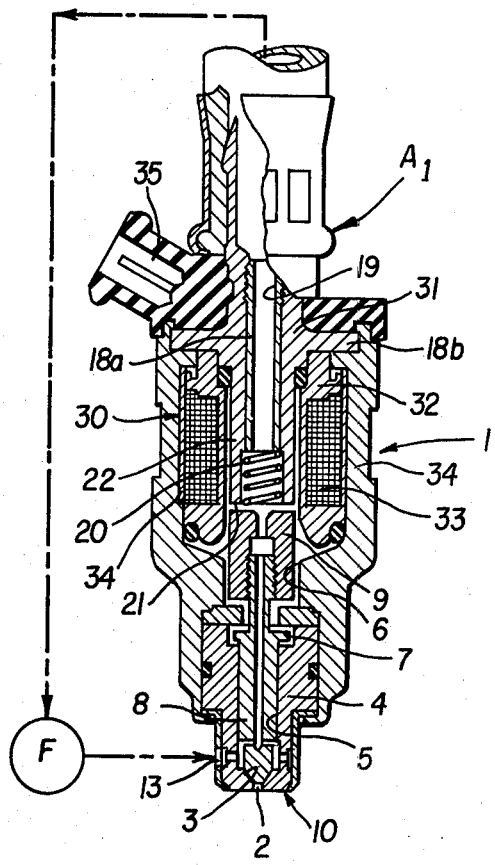
FIGS. 3 to 5 are, respectively, a longitudinal sectional view, a partially enlarged longitudinal sectional view and a transverse sectional view of the invention shown in FIG. 3.
Figure 4:
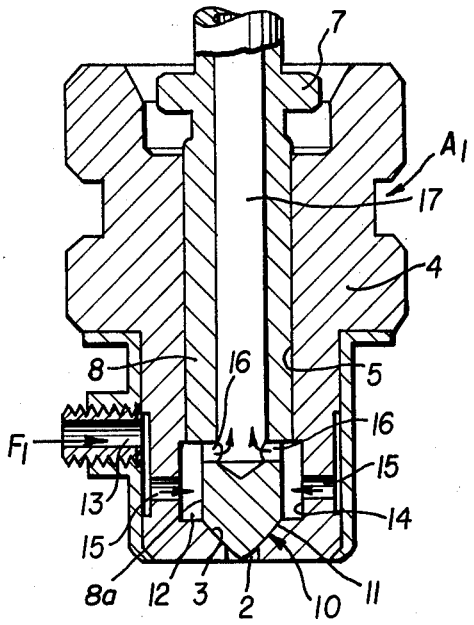
Figure 5:
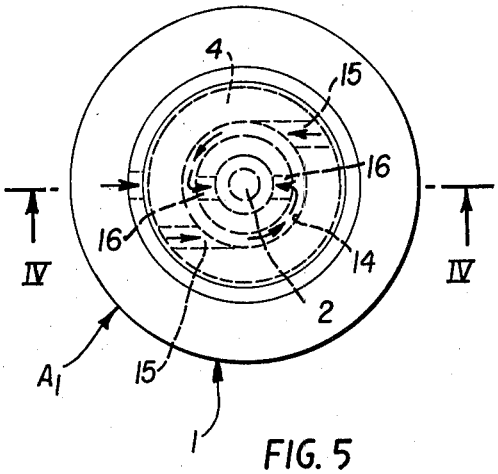

An improved spill type swirl injector $A_1$ according to a first embodiment of the present invention is made, as shown in FIGS. 3 to 5, into electromagnetic or electronic control type, in which a plunger is moved in accordance with the exciting pulse voltage impressed upon an electromagnetic coil to move a needle valve up and down in response to this movement to thereby open and close an injection port so that the quantity of the fuel to be injected may be regulated in accordance with the period for the power supply to the electromagnetic coil. The swirl injection valve is of electromagnetic or electronic control type (or Electronic Fuel Injector, which will be shortly referred to as E.F.I.). Injector $A_1$ is constructed to include a nozzle body 1 which is equipped with a nozzle member 4 formed with both of a fuel injection port 2 and a valve seat 3 of a conical shape located inwardly of and communicating with the injection port 2. The nozzle body 1 and the nozzle member 4 are formed at their center with a guide hole 6 and a needle valve guide bore 5, respectively. There are precisely fitted in a slidable manner in those guide bore 5 and a hole 6 both of a needle valve 8 formed with a stopper 7 and a plunger 9 connected integrally thereto. Within the nozzle member 4, the conical leading end of the needle valve 8 is adapted to air-tightly abut against the valve seat 3. There is also provided a valve device 10 which is operative to open and close the clearance between the valve seat 3 and the needle valve 3 so as to intermittently inject and supply the fuel in response to the vertical movements of the needle valve 8, which are effected by the energization and deenergization of the electromagnetic coil of a later-described electromagnetic needle valve control device 30.

The nozzle member 4 is formed with a longitudinal hollow portion at the center thereof and the inner diameter of the hollow portion at the tip or leading portion is larger than that thereof at the other portion than the tip portion. The outer peripheral wall of the needle valve 8 has a smaller diameter at the tip end thereof than that of the outer wall at the other portions than the tip portion. The swirl chamber 12 is defined by an annular recess formed between the inner peripheral wall at the tip portion of the nozzle member 4 and the outer peripheral wall at the tip portion of the needle valve 8. The swirl chamber 12 is communicated with the injection port 2 formed at the center of the nozzle member 4 through a conical pressure receiving surface 11 formed at the leading tip of the needle valve 8 when the needle valve 8 is moved upwardly. In the side wall of the nozzle member is provided supply source F by way of a external fuel pump (not shown). Moreover, there are formed between the swirl chamber 12 and the pressurized fluid induction passage 13 a pair of tangential pressurized fluid supply passages 15, which are made, as better seen from FIG. 5, to extend from the side wall of the nozzle member 4 in the tangential directions of the inner circumference 14 at the center in the axial direction of the swirl chamber 12. The tangential pressurized fluid supply passages 15 have their openings, the axes of which are oriented in the tangential directions of the inner circumference of the swirl chamber 12 so as to impart the swirling motions about the axis of the swirl chamber to the pressure fuel being supplied to the swirl chamber 12 and which are opened in the same direction as the swirling direction of the pressure fluid to thereby provide communication with the swirl chamber 12. Moreover, there are formed in the wall of the needle valve 8 a pair of spill openings 16 in the spill assembly which are made to have their axes perpendicular to the center of the swirl chamber 12, while communicating with the upper and inner portions of the swirl chamber in the axial direction.

The spill openings 16 are made to communicate with a pressure fuel spill passage 17 defined by an axial hole of the spill assembly, which extends substantially in parallel with the center of the swirl chamber 12. On the other hand, the nozzle body 1 has its inner wall 18 formed with a center conduit **18*a* and a coaxial positioning flange 18*b* fitting the former therein. The conduit 18*a* constitutes a pressure fuel discharge passage 19 communicated with the spill passage 17, which passage 19 extends through the center of the swirl chamber 12 and which has communication with the fuel supply source F. The other end of the plunger 9 is formed with a seat 21 for a spring 20 which is made operative to urge the needle valve 8 in the direction to abut against the valve seat 3. The other end of the spring valve 20 is in abutment engagement with a hollow member 22 which is fixedly fitted integrally in the pressure fuel discharge passage 19. There is arranged in the side wall of the nozzle body 1 the electromagnetic needle valve control device 30 which is mounted in an annular shape around the pressure fuel discharge passage 19 so as to control the vertical movement of the needle valve 8 in a satisfactorily airtight and insulated manner, as shown in FIG. 3. The needle valve control device 30 is composed of a stationary core 32, in which an inner wall member 31 holding therein the conduit 18*a* forming the pressure fuel discharge passage 19 is coaxially fitted, and of an electromagnetic coil 33 which is wound a plural number of turns around the outer periphery of the stationary core 32**.

A yoke 34 fixes the stationary core 32 while covering the electromagnetic coil 33. The nozzle body 1 has its outer wall member 34 covering the stationary core 32, electromagnetic coil 33 and yoke 34 and further the aforementioned nozzle member 4 integrally formed in a satisfactorily airtight and insulated manner. The aforementioned plunger 9 has its end portion fitted in the stationary core 32. As a result, the electromagnetic needle valve control device 30 generated an electromagnetic attraction, under the condition having its electromagnetic coil 33 supplied with the energizing pulse voltage, so that the plunger 9 is attracted and lifted to open the clearance between the needle valve 8 and the valve seat 3 to thereby inject and supply the fuel. On the contrary, as the energizing pulse voltage to the electromagnetic coil 33 is cut off, the electromagnetic attractive force simultaneously ceases so that the plunger 9 is moved down due to the biasing force of the valve spring 20 to close the clearance between the needle valve 8 and the valve seat 3 to thereby cut off the injection and supply of the fuel. On the other hand, the electromagnetic coil 33 is highly conductively connected to a connector 35, which in turn is highly conductively connected to a computer (not shown) through a wiring (also not shown) so that it can be supplied with excellent electrical characteristics with the electric injection signals which are computed by the computer and amplified by a power amplifier (not shown).

Figure 6:
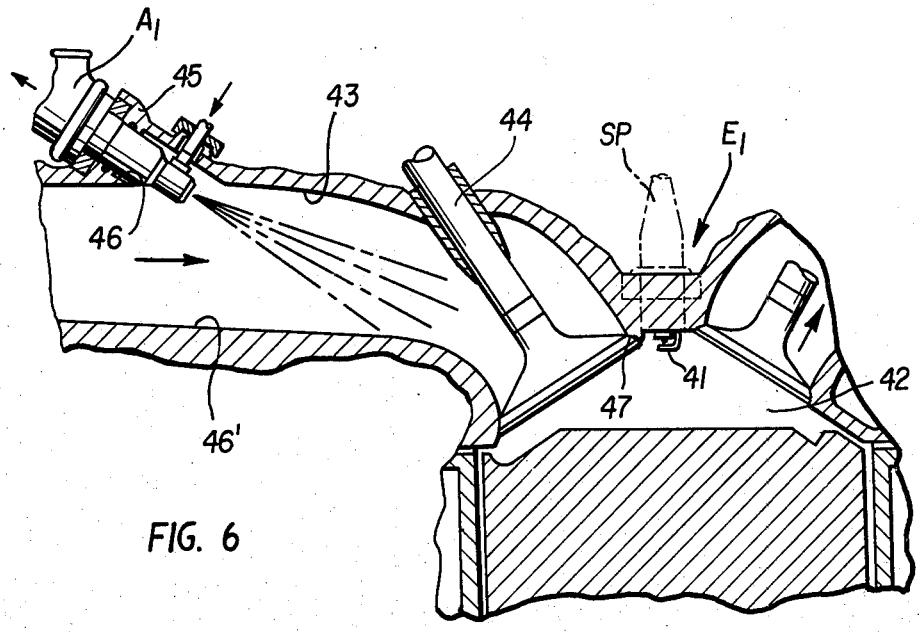
FIG. 6 is a sectional view of the spill type swirl injector of the first embodiment as applied to a gasoline engine.

A description will now be set forth of a mode, which the spill type swirl injector $A_1$, thus far described according to the first embodiment of the present invention, is applied to a gasoline (or spark ignition type) engine, with reference to FIG. 6.

The gasoline engine E is of the type in which the fuel supplied is injected into an intake pipe. As an intake system, the engine E has its intake passage 46' equipped at its upstream portion with both of an air filter and a throttle valve for controlling the flow rate of intake air by opening and closing, (both of which are not shown), and at its downstream portion with an intake port 43 which is in communication with a combustion chamber 42 equipped with a spark plug SP having its spark zone 41 arranged inside, and an intake valve 44 for controlling the opening and closing of the intake port 43. The spill type swirl injector $A_1$ according to the first embodiment is airtightly mounted in its mounting hole 46 which is formed in the wall 45 (or intake manifold) of the intake passage 46' upstream of the intake valve 44, such that is can inject the fuel in the direction toward the valve seat 47 of the intake valve 44.

The operation and effects of the spill type swirl injector $A_1$ according to the first embodiment thus constructed will be described in the following manner. In the suction stroke, the gasoline engine $E_1$ sucks a predetermined quantity of intake air and is drawn into its combustion chamber 42 by way of the throttle valve, the intake passage 46' and the intake valve 44. Meanwhile, the fuel is atomized and sprayed from the swirl injector $A_1$ toward the valve seat 47 with more excellent atomizing characteristics and more excellent response to the injection pressure than the prior art so that it can be efficiently and uniformly diffused and admixed with intake air thereby to prepare an air-fuel mixture of the desired mixture ratio. In the combustion chamber 42, the air-fuel mixture is then sucked and compressed during the compression stroke so that the compressed mixture is ignited by the spark plug SP and burnt to a proper end.

The operation of the swirl injector $A_1$ according to the first embodiment will now be detailed. In the swirl injector $A_1$, as shown in FIG. 3, in case the energizing pulse voltage to the electromagnetic coil 32 is cut off to cease the electromagnetic attractive force, the plunger 9 is held in its lower-most position by the action of the valve spring 20 to thereby shut off the clearance between the needle valve 8 and the valve seat 3 and accordingly the injection port 2. At this instant, the fuel under pressure is supplied to the pressurized fluid induction passage 13 formed in the nozzle member 4 and is then introduced into the tangential pressurized fluid supply passages 15. Since the tangential pressurized fluid supply passages 15 are made to have their openings oriented in tangential directions of the swirl chamber 12, as shown in FIG. 5, the fuel is so properly supplied with a swirling velocity that it is efficiently swirled in the swirl chamber 12 which is formed between the nozzle member 4 and the needle valve 8. Moreover, since the needle valve 8 is formed with spill openings 16 which are opened into the swirl chamber 12 and since the openings are made to communicate with the pressure fuel discharge passage 19 for discharging the fuel therethrough, the fuel is sufficiently swirled in the swirl chamber 12 and then is spilled through the openings 16 from the pressure fuel discharge passage 19 to the fuel supply source F. These series of communications are always continued while the pressure fuel is being supplied to the spill type swirl injector $A_1$.

In case, however, the swirl injector $A_1$ has its electromagnetic coil 32 supplied with the energizing pulse voltage to generate the electromagnetic attractive force, the plunger 9 is attracted against the biasing force of the valve spring 20 and is lifted to open the clearance between the needle valve 8 and the valve seat 3 to thereby open the injection port 2. At that time, the fuel swirling within the swirl chamber 12 is immediately injected from the injection port 2 in the form of an extremely thin liquid film. At the same time, the liquid film is sprayed to large extent so that the liquid droplets sprayed from the injection port 2 can be remarkably fine. Accordingly, the fuel is injected into the intake passage 46' form the injection port 2 with high response and in the form of atomized fine droplets. In this meanwhile, a portion of the fuel is spilled to the fuel supply source F via the spill openings 16 and the pressure fuel discharge passage 19. Since, however, the diameters of the aforementioned tangential pressurized fluid supply passages 15, spill openings 16 and injection port 2 are precisely preset, the flow rate of the fuel to be injected to the outside is determined precisely at a preset level while the needle valve 8 is attracted to open the valve seat 3. In other words, the quantity of the fuel to be injected to the outside can be adjusted exclusively in accordance with the time period during which the needle valve 8 is being attracted. This produces remarkably useful effects in practice in case the spill type swirl injector $A_1$ is applied to the reciprocating gasoline engine $E_1$.

In the spill type swirl injector $A_1$ according to the first embodiment of the present invention, moreover, since the spill openings 16 are formed in the needle valve 8 such that they are opened into the swirl chamber 12 in the vicinity of the central portion thereof. This provides a constant velocity intensive swirling flow in the swirl chamber 12 since the flow returned from the central portion of the chamber is of low velocity, leaving the high velocity flow available for atomization and injection. As a result, if the needle valve 8 is attracted at any time to open the valve seat 3, the liquid flow having a sufficiently high swirling velocity is injected from the injection port 2 immediately after the needle valve is opened so that a remarkably stable liquid film is formed and so that the liquid droplets sprayed therefrom can be remarkably fine.

Due to the provision of the spill openings 16 which are formed to open the swirl chamber 12 into the needle valve 8 at the central or inner portion of swirl chamber 12 the fuel is efficiently spilled under the higher pressure present within this inner region of the swirl chamber. This also sustains an intensive swirling flow in the swirl chamber 12. Also, due to such sustaining of an intensive swirling flow in the chamber 12, the atomizing characteristics at the initial stage of injection can be remarkably improved without delaying the injection timing and a stable injection quantity and injection angle are also provided. Thus, the spill type swirl injector $A_1$ according to the first embodiment of the present invention is very effective in its practical use. Since, moreover, the spill openings 16 are formed in the side wall of the needle valve 8 to thereby spill the fuel from the inside of the nearly central portion of the swirl chamber 12, the attenuations in the swirling flow in the swirl chamber 12 can be reduced to the minimum because the fuel is spilled from the above-mentioned portion of the swirl chamber 12 where the swirling velocity is small along the swirling direction of the fuel. Therefore, more intensive swirling flow can be established in the swirl chamber 12 so that the aforementioned effects can be enhanced all the more. Furthermore, according to the spill type swirl injector $A_1$ of the first embodiment, the fuel can be spilled from the nearly central portion of the swirl chamber 12 where the fuel pressure is large so that the spilling quantity of the fuel can be accurately controlled. Thus, since the spill openings 16 are formed in the side wall of the needle valve 8 and opened into the upper portion of the swirl chamber 12 to sustain a more intensive swirling flow of the fuel in the swirl chamber 12, remarkably satisfactory and stable atomizing characteristics can be realized from the beginning to the end of the injection with the resultant excellant practical effects.

In addition, the spill type swirl injector $A_1$ according to the first embodiment of the present invention can attain the following operational effects:

By selecting the sum of the effective areas of the tangential pressurized fluid supply passages 15 at a suitable ratio to the effective area of the injection port 2, it is possible to freely select the angle of expansion of the conical liquid film (atomized) to be injected from the injection port 2;

By spilling the pressure fuel as described above, it is possible to stabilize the angle of atomization (injection angle) to thereby make the atomization itself remarkably excellent even under a low injection pressure. Any by suitably selecting the size of the spill openings 16, moreover, it is possible to make the quantity of injection stable and precise. As a result, it is possible to attain the desired angle of atomization in accordance with the size ratio between the openings 16 and the injection port 2, thus making it remarkably feasible to design the nozzle; and By providing the characteristics that satisfactory atomization can be established in instant response to the start of injection, it is possible to find an excellent advantage in case the injection pulse has a remarkably short width (or injection period), such as a period shorter than 2 microseconds. Moreover, the shape, construction and their combination of the spill type swirl injector $A_1$ according to the first embodiment can be so remarkably simplified that the production, machining and assembly can be so facilitated in comparison with the various fuel injectors according to the prior art as to be suited for mass-production. The spill type swirl injector $A_1$ has such additional practical effects that is highly durable and reliable without any trouble, that it can be handled without any difficulty and that it can be produced at a low cost.

On the other hand, since the spill type swirl injector $A_1$ according to the first embodiment of the present invention can be applied to a gasoline (or spark ignition) engine $E_1$ of the type in which the fuel is injected into the intake pipe, the supply of the fuel injected can be accomplished so satisfactorily, as has been described before, that combustion can be effected completely. As a result, generation of noxious gases can be prevented to preclude air pollution due to the engine exhaust gases, and the running operations of the engine can be so stabilized and smoothened as to remarkably improve the various operating efficiencies of the engine and to remarkably reduce the cost for fuel consumption.

Figure 7:
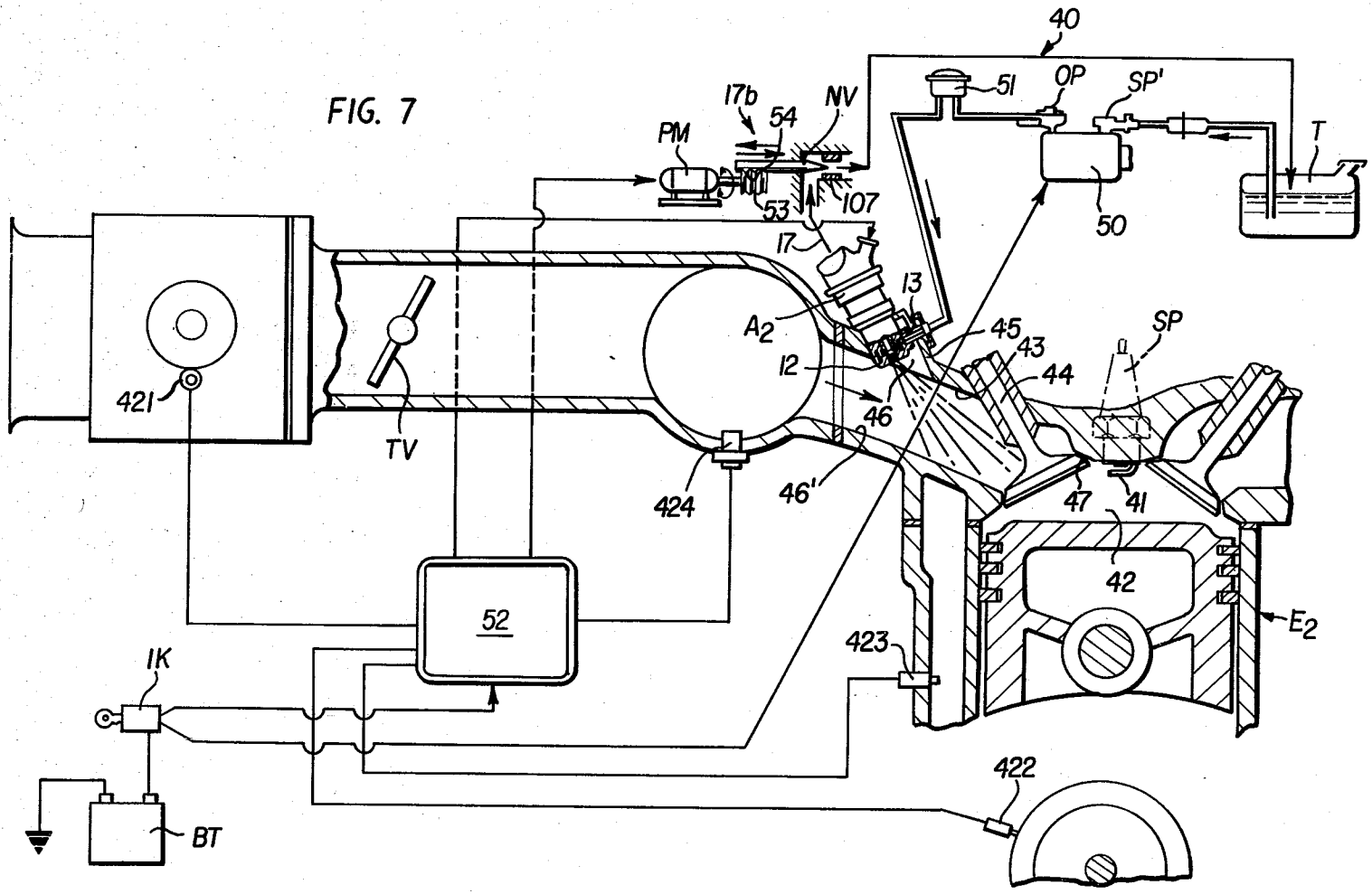
FIG. 7 is a schematic view showing the second embodiment of the present invention.
Figure 8:
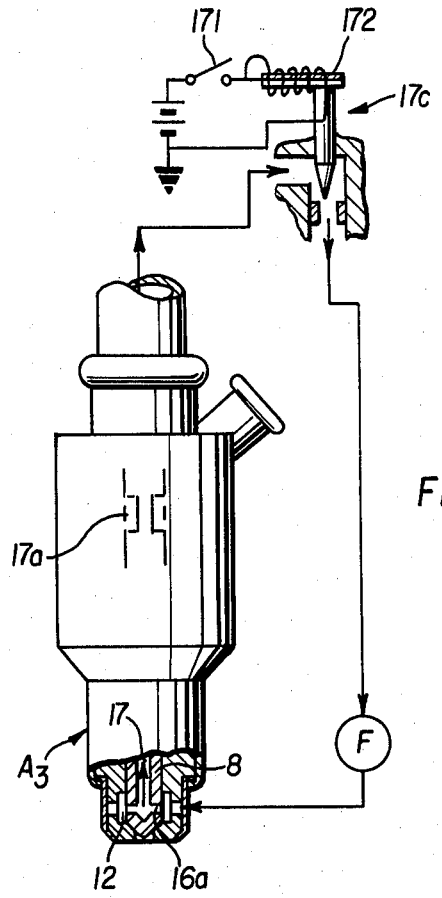
FIG. 8 is a schematic view showing the third embodiment of the present invention.

The spill type swirl injector according to the present invention should not be limited to the first embodiment thus far described but can be exemplified in second and third embodiments, as shown in FIGS. 7 and 8, respectively. Incidentally, identical portions to those in the first embodiment, as appearing in FIGS. 7 and 8 are designated with identical reference numerals, and their repeated descriptions are omitted here except for the differences therebetween.

The spill type swirl injector $A_2$ according to the second embodiment, as shown in FIG. 7, wherein a variable throttle **17*b* which is provided downstream of the spill openings 16, for controlling the spilling quantity of the fuel, is added to the spill type swirl injector of the first embodiment. The effective area of this throttle 17*b*** is electrically adjusted according to the running conditions of the engine, such as the temperature of the engine cooling water and the pressure in the intake manifold. As a result, it is possible to control the increase and decrease of the injection quantity of the fuel and not to change the pressure and flow rate of the fuel supplied from the fuel pump to the valve device and also the injection pulse width of the needle valve. Thus, supply of the fuel can be improved and the running efficiency of the engine can then also be improved.

In the spill type swirl injection $A_2$ according to the second embodiment, the pressurized fluid induction passage 13 is communicated with the fuel tank T provided at the rear part of an automobile through a pressure fuel supply system 40 for supplying a predetermined fuel and pressurizing the same to a predetermined pressure. A fuel spill passage 17 is also communicated with the downstream portion of the fuel tank T through the variable throttle valve **17*b*** for controlling the spilling quantity of the fuel.

The pressure fuel supply system 40 comprises a pump 50 driven by a motor having a suction port SP connected via a filter and pipes to the aforenoted fuel tank; a pressure regulating valve 51 connected to a discharge port DP of the pump 50 for controlling the pressure of the fuel being fed from the pump 50 to a given pressure level; a computer 52; a solenoid 33 (both of which are not shown) which is adapted to control the opening and closing of the needle valve 8 by an electromagnetic force, in response to a signal from the computer 52.

The computer 52 computes (i) a signal from an air flow sensor 421 positioned between an air cleaner (not shown) provided on an intake air passage 46 and a throttle valve TV and adapted to deliver an electric signal commensurate to the amount of air introduced under suction into the intake air passage 46, (ii) another signal from a r.p.m. sensor 422 adapted to deliver an electric signal commensurate to the r.p.m. of an engine by detecting the r.p.m. of the engine, and (iii) still another signal from a cooling-water-temperature sensor 423 positioned in a water jacket for a cylinder block of an internal combustion engine and adapted to deliver a signal commensurate to a temperature of engine cooling water, whereby the aforenoted computer 52 delivers a given pulse signal to the solenoid 33 positioned on the injector $A_2$, thereby controlling the valve opening cycle and the valve opening duration time, commensurate to the running condition of an engine. The computer 52 also computes a temperature signal from the cooling-water-temperature sensor 423 and a pressure signal from a pressure signal 424 inserted within an intake manifold. The computer 52 is also electrically connected to a pulse motor PM in the variable throttle 17*b*.

The computer 52 generates a predetermined control pulse signal to the pulse motor PM when the engine is cold or the engine is highly accelerated. The pulse motor insures a predetermined number of turns to right or left based on the pulse signal from the computer 52 so that a pinion 53 is rotated and driven by the pulse motor integral therewith. According to this rotation of the pinion 53, clutch 54 of a needle valve NV, which clutch is in engagement with the pinion 53, is linearly moved back or forth. Thus, the needle valve NV controls the effective area of the variable throttle 17*b* relative to a valve seat 107 opposite to the needle valve NV. Also, the spilling quantity of the fuel is controlled in response to running conditions of the engine $E_2$.

According to the second embodiment, the engine $E_2$ is started by means of an ignition key IK connected to a battery BT. However, this embodiment includes a relay means (not shown) insuring a predetermined sequence of operations, i.e., turning the ignition key on; driving the pump 50; starting the operation of the computer 52; and driving an engine starter.

According to the spill type swirl injector $A_2$ of the second embodiment having the aforenoted arrangement, the running condition of the engine $E_2$ is judged by the computer 52 provided in the pressure fuel supply system 40, based on signal from the air flow sensor 421 and r.p.m. sensor 422 based on the amount of intake air, engine r.p.m., with the result that the pulse width and pulse number of a pulse signal may be controlled so as to further control the valve opening cycle and valve-opening time duration for the injector $A_2$. Fuel of a given amount commensurate to the running condition of an engine is then intermittently injected from the injector $A_2$ in the form of a thin swirl-type liquid film, immediately after the needle valve 8 is opened.

Furthermore, the spill type swirl injector $A_2$ of this second embodiment may control the spilling quantity of the fuel in response to cooling water temperature of the engine $E_2$.

In the injector $A_2$ a variable throttle 17*b* is provided downstream of the spill openings 16, for controlling the spilling quantity of fuel based on the pulse signal from the computer 52. The computer 52 computes signals from a cooling-water-temperature sensor 423 and signals from the pressure sensor 424 and is adapted to deliver a signal commensurate to a temperature of engine cooling water and the pressure in the intake manifold. Thus, the running condition of the engine is judged from such cooling water temperature and the pressure in the intake manifold and then the pulse width, pulse numbers and the timing of the control pulse signal from the computer 52 is controlled based on the judgement thereof. Since the effective area of the variable throttle 17*b* is electrically adjusted without changing pulse width of the injection and the injection quantity in the injector is controlled, i.e., it is possible to increase the quantity of fuel at the start and upon acceleration with injection pulse width being invaried. An intake-air-temperature sensor 33 may be employed in place of the cooling-water-temperature sensor 423 or the pressure sensor 424.

Further, in the swirl injector $A_2$ according to the second embodiment, when the effective area of the variable throttle 17*b* becomes large, the spilling quantity fuel is increased so that the injection pressure becomes low to thereby reduce the injection quantity and injection angle of fuel. On the contrary, when the effective area of the variable throttle 17*b* becomes small, the spilling quantity of fuel is decreased so that the injection pressure becomes high thereby to increase the injection quantity and injection angle of fuel. Thus, according to this swirl injector of the second embodiment, fuel can be satisfactorily injected in response to the running condition of the internal combustion engine.

A spill type swirl injector $A_3$ according to a third embodiment of the present invention, as shown in FIG. 8, will be described hereinafter.

In this injector $A_3$ of the third embodiment, a pair of spill openings 16*a* is arranged to be opened into a middle portion in the axial direction of the swirl chamber 12 and into the same cross section as that of the tangential pressurized fluid supply passages 15. A throttle 17*a* is provided in an axial hole in the nozzle body which is positioned downstream of the spill openings 16*a* for controlling the spilling quantity of fuel to a predetermined value. A variable throttle 17*c* is also provided downstream of the throttle 17*a* to electrically adjust the effective area of the throttle 7*c* in response to the running condition of an engine at the start and upon acceleration of an engine.

According to this spill type swirl injector $A_3$ of the third embodiment, the fuel within the swirl chamber 12 is intensively or strongly swirled from the outer periphery to the center thereof and thereafter the fuel is spilled therefrom along the swirling direction through the spill openings 16*a* provided so as to face the center portion of the swirl chamber 12. As a result, it is possible to establish the intensive or strong swirling flow within the swirl chamber 12 without losing the swirling energy. Also, spilling quantity of fuel can be controlled with high accuracy and ease.

Furthermore, the variable throttle 17*c* makes an ON-OFF switch 171 open or close in response to changes in temperatures of an intake manifold and engine cooling water and in response to negative pressure of an intake manifold. When the switch 171 is closed, it contacts a bimetal 172 connected to a needle valve 173 of the variable throttle 17*c* and then heats the same whereby the bimetal 172 is bent downward and consequently, the needle valve 173 connected to the bimetal 172 is moved downward. The effective area of the variable throttle 17*c* is adjusted within the limit of the effective area of the above-mentioned throttle 17*a* to thereby control the injection quantity of fuel so as to increase or decrease the same and to supply the injection fuel in a satisfactory manner at the start of the engine and upon acceleration thereof, without changing the pressure and quantity of fuel supplied to the injection pump and injection pulse width or pulse numbers. Thus, the spil type swirl injector $A_3$ according to the third embodiment can provide advantageous and excellent effects as mentioned above in its practical use.

Still further, by providing a throttle 17*a* for regulating the spilling quantity of fuel to a predetermined value, downstream of the spill openings 16*a* as close to the swirl chamber 12 as possible, and preferably, by suitably sizing the effective area of the throttle 17*a* with respect to that of the injection port 2, generally, by making the former smaller than the latter, it is possible to establish stable atomization with excellent response to the opening of the needle valve 8 althrough the spilling quantity of fuel is considerably smaller than that of injection. According to such construction, moreover, control of injection can be accomplished remarkably accurately and feasibly because the quantity of fuel to be injected from the needle valve 8 is proportional to the time period during which the needle valve 8 is kept open. It is also possible to make the atomization itself remarkably excellent with uniform particle diameter of fuel being injected and to stabilize the injection angle.

Figure 9:
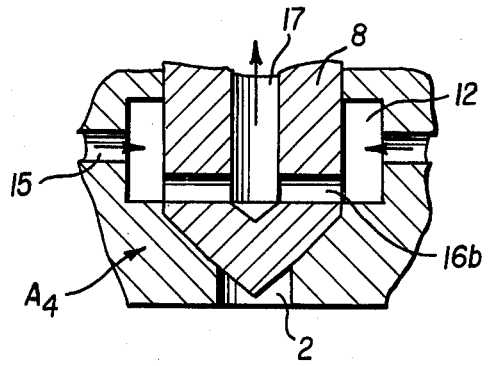
FIGS. 9 and 10 are, respectively, cut-away longitudinal, sectional views showing modifications of the present invention.
Figure 10:
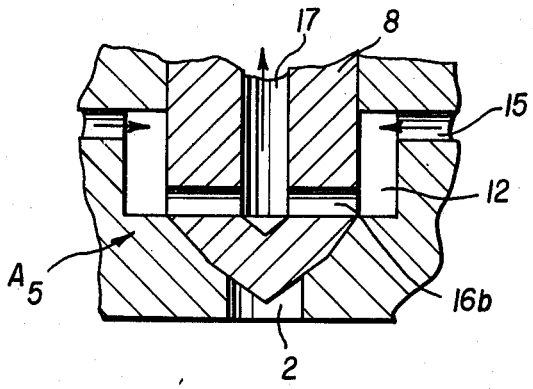

The modifications of the spill type swirl injector according to the present invention are respectively shown in FIGS. 9 and 10. A spill type swirl injector $A_4$ of the modification according to the present invention, as shown in FIG. 9, is arranged in such a manner that spill openings 16*b* are opened into a lower portion of the swirl chamber 12 and the tangential pressurized fluid supply passages 15 are opened into a middle part of the outer side wall of the swirl chamber 12.

A spill type swirl injector $A_5$ as shown in FIG. 10 is arranged in such a manner that the tangential pressurized fluid supply passages 15 are provided at an upper portion of the swirl chamber and the spill openings are opened into a lower portion of thw swirl chamber 12.

In these spill type swirl injectors $A_4$ and $A_5$ which are respectively shown in FIGS. 9 and 10, the fuel is intensively or strongly swirled from the outer periphery of the swirl chamber 12 to the center thereof within the swirl chamber. Thereafter, a part of fuel being swirled from the tangential passages 15 toward the injection port 2 is spilled through the spill openings 16. In the same manner as in the above-mentioned embodiments, it is possible to establish sufficiently intensive swirling flow within the swirl chamber.

Figure 11:
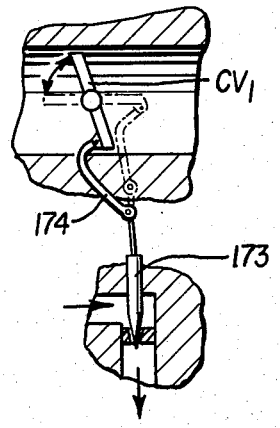
FIGS. 11 and 12 are, respectively, schematic views showing modifications of the variable throttle which is applied to the present invention.
Figure 12:
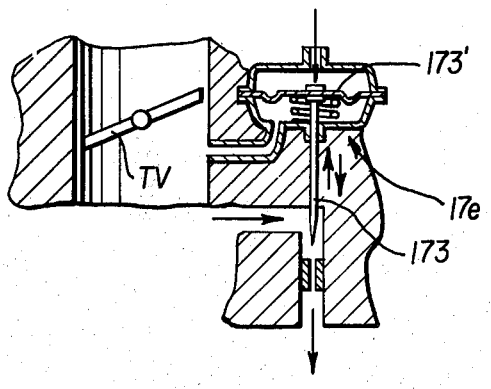

FIGS. 11 and 12 show modifications of a variable throttle, respectively. These modifications have the advantage that the construction thereof is simplified. A variable throttle 17*d* as shown in FIG. 11 moves a needle vlave 173 directly back and forth through a linkage (link mechanism) 174 connected to one end of a choke valve $CV_1$ to control the effective area of this throttle 17*d*. Thus arranged, throttle 17*d* is the most preferable in the case of control of the increase of fuel at the start of an internal combustion engine.

A variable throttle 17*e* as shown in FIG. 12 is provided with a throttle valve TV for introducing negative pressure in the intake manifold by controlling opening or closing thereof at one side thereof having a coil spring. The throttle 17*e* is also provided with a diaphragm switch 173 for introducing the atmosphere at the other end thereof. By balancing the negative pressure with the atmosphere, the needle valve 173 is directly moved back and forth to thereby control the effective area of the variable throttle 17*e*. Thus it is preferably in the case of control of the increase of fuel upon acceleration of an internal combustion engine.

In addition to the aforementioned modifications, in case the spilling quantity of fuel is controlled by changing the effective area of the variable throttle based on engine cooling water or the like, a wax actuator may be employed. Namely, expansion of the wax may be directly transmitted to the needle valve of the variable throttle by means of such a wax actuator.

Thus, the improved spill type swirl injector according to the present invention can enjoy such practical effects that the fuel can be injected, immediately after the valve is opened, in the form of a liquid film flow having a sufficiently intensive swirling velocity so that the liquid droplets sprayed therefrom can be made remarkably fine with the resultant satisfactory atomizing characteristics which have never been obtained according to the prior art. The spill type swirl injector according to the present invention can enjoy additional practical effects in that the construction can be so simplified as to remarkably facilitate production, machining and assembling and to be suited for mass-production, that it is highly durable and reliable, that it can be handled with ease and be produced at a low cost, and that the atomization characteristics of the liquid as a pressure fluid can be remarkably improved together with the high response of atomization to the injection pressure. On the other hand, spill type swirl injector according to the present invention can expect high practical advantages if it is applied in various industrial fields. If, for instance, the spill type swirl injector of the present invention is applied to an internal combustion engine, a proper supply of injected fuel can be ensured to complete sufficient combustion to prevent noxious gases from being generated and the ambient air from being polluted with the engine exhaust gases. Such practical effects can also be attained such that the engine can be driven stably and smoothly to remarkably improve the various operating efficiencies and to remarkably reduce the cost for fuel consumption.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A spill type swirl injector comprising:

a nozzle body having an inner cylindrical wall;

a pressurized fluid supply source;

an injection port opening at one end of said nozzle body for injecting pressurized fluid;

pressurized fluid supply passage means;

a pressurized fluid induction passage provided within said nozzle body, said pressurized fluid induction passage being connected to said pressurized fluid supply source through said pressurized fluid supply passage means;

valve means including a movable member interposed into said injection port for controlling the fluid injection by on-off controlling the fuel supply to said injection port;

a swirl chamber comprising an annular chamber formed between said inner cylindrical wall of said end of said nozzle body and an outer cylindrical wall of said movable member of said valve means, at a position adjacent to said injection port within said nozzle body, said swirl chamber being connected to said injection port;

first and second tangential pressurized fluid supply passages formed within said nozzle body in communication with said pressurized fluid induction passage and opening into said inner cylinder wall of said nozzle body of said swirl chamber in the tangential direction thereof for forming swirling flow of said pressurized fluid within said swirl chamber; and spill means comprising said movable member having first and second spill openings formed therein communicating with said outer cylindrical wall of said movable member of the valve means and opened into said outer cylindrical wall of said movable member in said swirl chamber;

said first and second spill openings being diametrically opposite each other, and said first and second spill openings being positioned at a distance farther from said fuel injection port than said tangential pressurized fluid supply passages when said injecton port is closed by said valve means; and first spill passage means comprising said movable member having an axial hole formed therein communicating with said two spill openings, and said nozzle body having second spill passage means formed therein communicating with said axial hole and said pressurized fluid supply source, thereby spilling a predetermined quantity of the pressurized fluid from said outer cylindrical wall of said movable member in said swirl chamber through said first and second spill openings, said axial hole and said second spill passage means, without decreasing the swirling energy of the swirling flow in said swirl chamber, such that the fluid is injected in the form of a liquid film flow having a sufficiently high swirling velocity immediately after the valve is opened so that the sprayed liquid droplets are fine and uniform and the atomozing characteristics and response of atomization to the injection pressure are improved.

2. A spill type swirl injector according to claim 1, further comprising;

throttle means having a predetermined constant throttle provided in said second spill passage means, thereby stably maintaining the spilling quantity of the pressurized fluid flowing through said second spill passage means constant and stably maintaining the injection quantity of the pressurized fluid injected from said injection port.

3. A spill type swirl injector according to claim 1, wherein said first and second spill openings are opened into a top portion of said said swirl chamber, and said first and second tangential pressurized fluid supply passages opening into a middle part of the height of said inner cylindrical wall of said swirl chamber.

4. A spill type swirl injector according to claim 1, wherein said first and second tangential pressurized fluid passages respectively open at symmetrically opposite positions with respect to the axis of said swirl chamber.

5. A spill type swirl injector according to claim 3, said first and second tangential pressurized fluid supply passages comprising two tangential pressurized fluid supply passages which respectively open at symmetrically opposite positions with respect to the axis of said swirl chamber.

6. A spill type swirl injector according to claim 5, wherein said nozzle body comprises a hollow cylindrical member having a bottom portion at a tip end thereof;

said injection port comprises a small hole having a predetermined diameter coaxially provided at said bottom portion of said nozzle body;

said pressurized fluid induction passage comprises an annular passage surrounding said swirl chamber, said valve means comprise said movable member comprising a plunger inserted within said nozzle body, and a needle valve having a cone shape tip portion connected to said plunger;

an annular magnet coil surrounding said plunger and connecting an electrical source;

coil means for pressing said plunger inserted within said nozzle body; and a valve seat comprising a cone shape recess coaxially provided in said injection port at said bottom portion of said nozzle body.

* * * * *